US005694902A

United States Patent [19]

Miwa et al.

[11] Patent Number: 5,694,902

[45] Date of Patent: Dec. 9, 1997

[54] FUEL SUPPLY CONTROL WITH FUEL PRESSURE ADJUSTMENT DURING FUEL CUT-OFF DELAY PERIOD

[75] Inventors: Makoto Miwa; Naoki Yoshiume, both of Kariya, Japan

[73] Assignee: Denso Corporation, Kariya, Japan

[21] Appl. No.: 756,335

[22] Filed: Nov. 26, 1996

[30] Foreign Application Priority Data

Dec. 12, 1995 [JP] Japan ..... 7-322108

[51] Int. Cl.[6] ..... F02M 51/00

[52] U.S. Cl. ..... 123/493; 123/497

[58] Field of Search ..... 123/493, 492, 123/495, 497, 510, 511, 458, 478, 514, 325, 339

[56] References Cited

U.S. PATENT DOCUMENTS

| | | | |
|---|---|---|---|
| 4,694,796 | 9/1987 | Mori | 123/325 |
| 4,721,083 | 1/1988 | Hosaka | 123/339 |
| 4,784,103 | 11/1988 | Ohishi | 123/493 |
| 4,962,742 | 10/1990 | Nishizawa et al. | 123/492 |
| 5,095,877 | 3/1992 | Kikuchi et al. | 123/492 |
| 5,379,741 | 1/1995 | Matysiewicz et al. | 123/497 |
| 5,483,940 | 1/1996 | Namba et al. | 123/497 |

*Primary Examiner*—Raymond A. Nelli
*Attorney, Agent, or Firm*—Nixon & Vanderhye P.C.

[57] ABSTRACT

A fuel cut-off operation is delayed until a predetermined delay time period elapses after a fuel cut-off condition is satisfied. During the delay period, the voltage for driving a fuel pump is gradually dropped to decrease the rotation speed of the fuel pump gradually. Thus, the discharge pressure of the fuel pump is low and hence the rise of a fuel pressure immediately after the fuel cut-off operation starts can be prevented. After the fuel cut-off condition, updating of a fuel pressure feedback correction amount is prohibited until the fuel cut-off operation terminates. In this manner, a feedback control immediately after the fuel cut-off operation terminates is executed by using the feedback correction amount used immediately before the fuel cut-off condition to prevent the drop of the fuel pressure immediately after the fuel cut-off operation terminates. Thus, the fuel pressure can be maintained at a target fuel pressure.

13 Claims, 4 Drawing Sheets

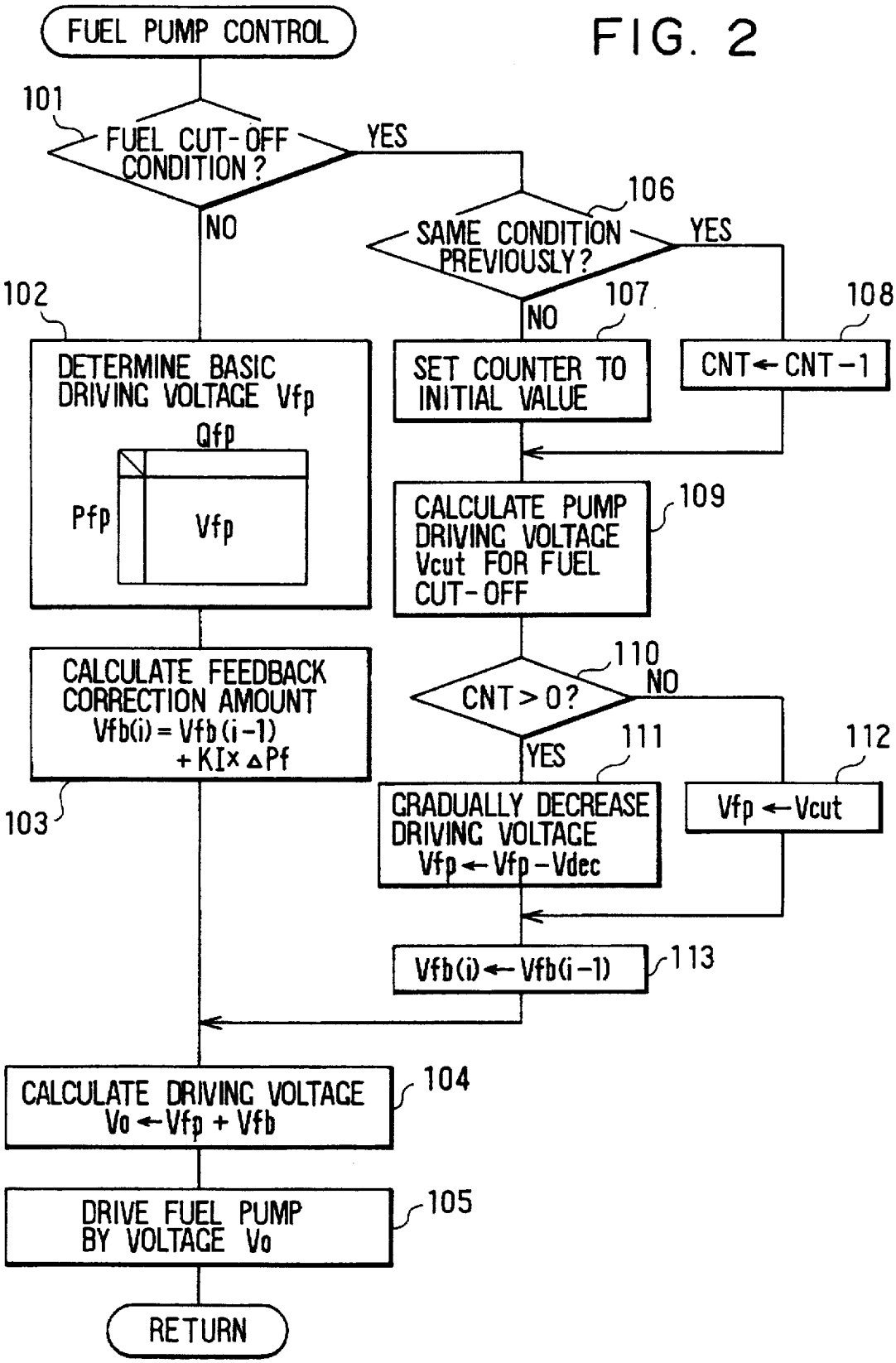
FUEL PUMP CONTROL
FIG. 2
101
FUEL CUT-OFF CONDITION?
YES
NO
106
SAME CONDITION PREVIOUSLY?
YES
NO
102
107
108
DETERMINE BASIC DRIVING VOLTAGE Vfp
Qfp
Pfp
Vfp
SET COUNTER TO INITIAL VALUE
CNT←CNT−1
CALCULATE PUMP DRIVING VOLTAGE Vcut FOR FUEL CUT-OFF
109
CALCULATE FEEDBACK CORRECTION AMOUNT
Vfb(i)=Vfb(i−1)
+KI×ΔPf
110
CNT>0?
NO
YES
111
112
103
GRADUALLY DECREASE DRIVING VOLTAGE
Vfp←Vfp−Vdec
Vfp←Vcut
Vfb(i)←Vfb(i−1)
113
CALCULATE DRIVING VOLTAGE
Vo←Vfp+Vfb
104
DRIVE FUEL PUMP BY VOLTAGE Vo
105
RETURN

DELAY
FUEL CUT-OFF FLAG
ON
OFF
FUEL CUT-OFF

Vfp
Vcut

+
Vfb
0
−

Vo

Pf

FUEL SUPPLY CONTROL WITH FUEL PRESSURE ADJUSTMENT DURING FUEL CUT-OFF DELAY PERIOD

BACKGROUND OF THE INVENTION

1. Field of the Invention

The present invention relates to a fuel supply system for an internal combustion engine in which a pressure of fuel to be supplied to fuel injectors is adjusted by controlling the voltage for driving a fuel pump.

2. Description of Related Art

According to a fuel supply system disclosed in Japanese Patent Application Laid-open Publication No. 62-32228, in order to reduce a fuel consumption and an electric power consumption, a fuel cut-off signal is generated to stop the injection of fuel and the voltage for driving a fuel pump is cut off to stop the fuel pump, when the condition of stopping fuel injectors from injecting the fuel is satisfied (for example, at engine deceleration time).

In the fuel supply system having the above-described construction, the fuel pump is stopped while fuel injection is cut off and then actuated immediately after the fuel cut-off operation terminates to resume the injection of the fuel. However, in this construction, some period of time is required until the fuel pump rotates at a speed fast enough to discharge a necessary amount of the fuel. That is, the fuel pump delays discharging the necessary amount of the fuel immediately after the fuel cut-off operation terminates. As a result, the fuel pressure becomes nonuniform and thus a stable fuel injection amount cannot be obtained, which adversely affects on the drive performance and exhaust gas emission.

Even though the voltage for driving the fuel pump is cut off when the fuel cut-off operation starts, the fuel pump continues to rotate for some time due to its inertia, thus discharging the fuel. Therefore, in a fuel supply system having a fuel returnless pipe construction to the injectors, the fuel pressure rises because the fuel pump continues to rotate for some time due to its inertia after the fuel cut-off operation starts. Consequently, the air-fuel ratio of air-fuel mixture immediately after the fuel cut-off operation terminates becomes richer than the stoichiometric air-fuel ratio, which causes drive performance to be unreliable and gaseous emission to be deteriorated.

SUMMARY OF THE INVENTION

The present invention has accordingly has an object to provide a fuel supply system for an internal combustion engine having an improved fuel control characteristic and fuel injection characteristic immediately after a fuel cut-off operation terminates, so that the fuel supply system allows a car to have an improved drive performance and exhaust gas emission.

In order to achieve the above object, in a fuel supply system for an internal combustion engine, when a fuel cut-off condition of cutting fuel injection of the injector is satisfied, a fuel cut-off operation is performed only after the elapse of a predetermined period of time. During this period of time, the fuel supply performance of the fuel pump is reduced before starting the fuel cut-off operation. The fuel pump is allowed to have a reduced degree of inertia when the fuel cut-off operation starts, and further, the rise of the fuel pressure can be prevented immediately after the fuel cut-off operation starts. This construction is effective to maintain the fuel pressure during the fuel cut-off operation at an appropriate degree and improves the fuel control characteristic and fuel injection characteristic immediately after fuel cut-off operation terminates. Therefore, the fuel supply system has an improved drive performance and exhaust gas emission.

Preferably, in order to reduce the fuel supply performance of the fuel pump when the fuel cut-off condition is satisfied, the rotation speed of the fuel pump is decreased when the fuel cut-off condition is satisfied. In a system in which the pressure of fuel is adjusted by controlling the voltage for driving the fuel pump, the fuel supply performance of the fuel pump can be reduced by reducing the voltage for driving the fuel pump when the fuel cut-off condition is satisfied.

Preferably, the predetermined period of time between the time at which the fuel cut-off condition is satisfied and the time at which the fuel cut-off operation starts is set to be long when the pressure of the fuel is high or when the amount of the fuel, discharged immediately before the fuel cut-off operation starts is large. This is because the higher the fuel pressure is or the more the amount of the fuel discharged immediately before the fuel cut-off operation starts is, the larger the rotation speed of the fuel pump has. Therefore, the fuel pump has a great inertia and thus it takes a certain period of time to reduce the degree of inertia (the rotation speed) of the fuel pump to an appropriate one required at the start time of the fuel cut-off operation. That is, a stable control can be accomplished without being affected by the fuel pressure or the amount of the fuel discharged immediately before the fuel cut-off operation starts by variably setting the predetermined period of time according to the fuel pressure or the amount of the fuel discharged immediately before the fuel cut-off operation starts.

Preferably, during the fuel cut-off operation, the voltage for driving the fuel pump is set to a possible minimum voltage for maintaining a target fuel pressure to be generated after the fuel cut-off operation terminates. In this manner, during the execution of the fuel cut-off operation, the fuel pump can be rotated at a low speed to prevent the fuel pressure from fluctuating, and yet immediately after the fuel cut-off operation terminates, the rotation speed of the fuel pump can be promptly returned to the rotation speed set before the fuel cut-off operation starts. Therefore, the fuel pressure can be prevented from being reduced immediately after the fuel cut-off operation terminates.

Preferably, the voltage for driving the fuel pump is reduced gradually for the predetermined period of time, thus preventing a rapid change in the rotation speed of the fuel pump after the fuel cut-off condition is satisfied and suppressing the drop of the fuel pressure.

Preferably, for the predetermined period of time, updating of a fuel pressure feedback correction amount to be used in a feedback control is prevented, thus maintaining the feedback correction amount having used immediately before the fuel cut-off condition is satisfied. That is, while the fuel cut-off operation is being executed, the injectors do not inject the fuel and hence it is unnecessary to execute the feedback control in adjusting the voltage for driving the fuel pump. Therefore, the updating of the feedback correction amount is prohibited, and the feedback correction amount to be used immediately after the fuel cut-off operation terminates is set to be equal to the one having been used immediately before the fuel cut-off operation is satisfied. In this manner, immediately after the fuel cut-off operation terminates, the voltage for driving the fuel pump can be stably adjusted by the feedback control without being affected by the fuel cut-off operation.

BRIEF DESCRIPTION OF THE DRAWINGS

Other objects, features and advantages of the present invention will become more apparent from the following detailed description when read in conjunction with the accompanying drawings, in which:

FIG. 2 is a flowchart showing a flow of executing processing of a fuel pump control routine;

DETAILED DESCRIPTION OF PRESENTLY PREFERRED EMBODIMENT

A fuel supply system for an internal combustion engine according to an embodiment of the present invention is described below with reference to the accompanying drawings.

Figure 1:
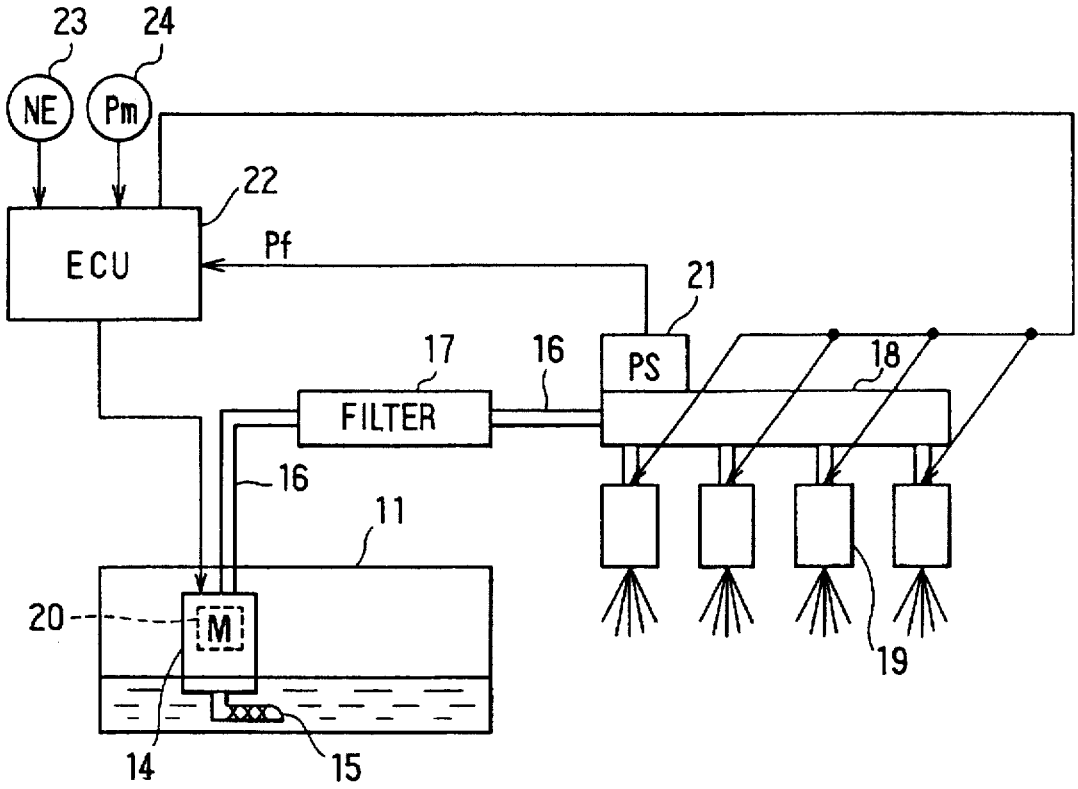
FIG. 1 is a schematic diagram showing an entire fuel supply system according to an embodiment of the present invention.

As shown in FIG. 1, a fuel tank 11 accommodates therein an electric motor-driven fuel pump 14 having a filter 15 attached to the inlet port thereof. A fuel filter 17 for catching dust in fuel is installed inside a fuel pipe 16 connected with a discharge or outlet port of the fuel pump 14. A plurality of injectors 19 which inject the fuel to respective cylinders of an engine is installed on a delivery pipe 18 connected with an end of the fuel pipe 16. A fuel supply path starts from the fuel tank 11 and terminates at the delivery pipe 18 and has no return pipe for returning excess fuel to the fuel tank 11 from the delivery pipe 18.

The fuel pump 14 accommodates a DC motor 20 serving as its driving source. The voltage to be applied to the DC motor 20 is adjusted by PWM (pulse width modulation) control or a DC-DC converter to control the rotation speed of the fuel pump 14. In this manner, the discharge pressure (fuel supply performance) of the fuel pump 14 is controlled. The pressure Pf of the fuel discharged from the fuel pump 14 is detected by a fuel pressure sensor 21 installed on the delivery pipe 18. The fuel pressure sensor 21 may be installed on the fuel pipe 16 such that it is located at the discharge side of the fuel pump 14.

An electronic control unit (ECU) 22 which controls the operation of the fuel pump 14 and that of the injectors 19 comprises a microcomputer. The ECU 22 receives at its input ports pulse signals corresponding to the number NE of rotations or rotation speed of an engine outputted from a crank angle sensor 23, signals corresponding to an intake air pressure Pm inside an intake pipe outputted from a pressure sensor 24, and signals corresponding to the fuel pressure Pf outputted from the fuel pressure sensor 21. The ECU 22 executes processing of a fuel pump control program shown in FIG. 2 and stored in an unshown ROM of the ECU 22, thereby to control the voltage for driving the fuel pump 14.

The processing of the fuel pump control routine shown in FIG. 2 is repeatedly executed in short cycles. When processing starts, it is determined at step 101 whether or not a fuel cut-off condition is satisfied. That is, whether a cut flag shown in FIG. 4 is ON or not is determined. The following two conditions are regarded as the fuel cut-off condition:

(1) when a throttle valve of the engine is completely closed and the rotation speed of the engine is more than a set one (in engine deceleration); or (2) when the rotation speed of the engine exceeds a highest allowable zone (an excessively high speed).

When the fuel cut-off condition is not satisfied, a normal control is executed at steps subsequent to step 102. In the normal control, at step 102, in order to determine a basic driving voltage Vfp for driving the fuel pump 14, interpolation calculations are performed by retrieving it from a two-dimensional map of a predetermined necessary discharge pressure Pfp and a predetermined necessary fuel exhaust amount Qfp. The two-dimensional map is a table data stored in the ROM of the ECU 22 and indicates, based on the performance characteristic of the fuel pump 14, the relationship between the basic driving voltage Vfp and the necessary fuel discharge amount Qfp as well as the necessary discharge pressure Pfp.

The necessary fuel discharge amount Qfp is determined, based on the modulation (injection period of time) of injection pulses to be applied to the injectors 19 and the rotation speed NE of the engine determined from the output pulse signals of the crank angle sensor 23, using an equation shown below:

$$Qfp=\alpha\times NE\times Ti$$

where $\alpha$ is a coefficient to be determined according to the flow rate of fuel to be injected from the injectors 19, the number of the injectors 19, and injection methods. In the fuel supply system, according to this embodiment having the fuel returnless pipe construction from the delivery pipe 18 to the fuel tank 11, the necessary fuel discharge amount Qfp is equal to a demand fuel injection amount.

The necessary discharge pressure Pfp is determined based on the fuel pressure Pfo of the fuel supply system and the pressure Pm inside the intake pipe detected by the pressure sensor 24, using an equation shown below:

$$Pfp=Pfo+Pm$$

where the system fuel pressure Pfo is a system demand fuel pressure which makes constant the difference between the fuel pressure Pfo and the pressure Pm inside the intake pipe. Generally, the fuel pressure Pfo is set to a constant value in the range of 200 kPa–350 kPa. Normally, the fuel pressure Pfo is set to a low value. When an engine temperature is high, vapor (fuel-evaporated gas) is likely to be generated in the fuel pipe 16. In such a drive state, the fuel pressure Pfo is set to a high value to prevent the generation of vapor. The necessary discharge pressure Pfp required to be supplied by the fuel pump 14 is determined at a gauge pressure (difference between necessary discharge pressure Pfp and atmospheric pressure). Thus, the necessary discharge pressure Pfp is determined by adding the pressure Pm inside the intake pipe to the system fuel pressure Pfo.

In this embodiment, the pressure Pm inside the intake pipe is determined from output signals of the pressure sensor 24, whereas generally, a fuel supply system in which an intake air amount is measured by an air flow meter is not provided with a pressure sensor for detecting the pressure inside the intake pipe. In such a fuel supply system, the pressure Pm inside the intake pipe may be estimated based on the drive condition of the engine, namely, the rotation speed of the engine and an intake air amount.

After the basic driving voltage Vfp for driving the fuel pump 14 is determined according to the necessary discharge pressure Pfp and the necessary fuel discharge amount Qfp at step 102, a fuel pressure feedback correction amount Vfb for the basic driving voltage Vfp is calculated at step 103, based on a deviation $\Delta Pf$ (=Pfp–Pf) between the necessary discharge pressure Pfp and a fuel pressure Pf detected by the fuel pressure sensor 21, using an equation shown below:

$$Vfb(i)=Vfb(i-1)+KI\times\Delta Pf$$

where Vfb(i) is the value of Vfb determined at an execution of a current time; Vfb(i−1) is the value of Vfb determined at an execution of a previous time; and KI is an integration coefficient. The feedback correction amount Vfb is used to compensate an excess amount or a shortage amount (deviation from basic driving voltage Vfp) in a discharge amount and a discharge pressure brought about by performance variation of the fuel pump 14 and its deterioration with age.

At step 104, the driving voltage Vo for driving the fuel pump 14 is determined by adding the feedback correction amount Vfb to the basic driving voltage Vfp. Then, at step 105, the driving voltage Vo is applied to the fuel pump 14 to drive it.

If the fuel cut-off condition is satisfied at step 101, the program goes from step 101 to step 106 at which it is determined whether or not the fuel cut-off condition was satisfied in the execution of this routine at the previous time. If it is determined at step 106 that the fuel cut-off condition was not satisfied in the execution of the routine at the previous time and is satisfied in the execution thereof at the current time, the program goes to step 107 at which a delay counter CNT is set to its initial value corresponding to a predetermined delay period of time for delaying execution of fuel cut-off. If it is determined at step 106 that the fuel cut-off condition was satisfied in the execution at the previous time and is also satisfied in the execution at the current time, the program goes to step 108 at which the delay counter CNT is decremented by "1". The delay counter CNT counts the delay time period from the time at which the fuel cut-off condition is satisfied to the time at which a fuel cut-off operation starts. The delay time period is set in anticipation of a response delay of the fuel pump 14 in starting the fuel cut-off operation. It is to be noted that the higher a set fuel pressure is, the greater torque the fuel pump 14 has and that the more the amount of the fuel discharged immediately before the fuel cut-off operation starts is, the larger rotation speed the fuel pump 14 has. Thus, it takes a certain period of time to reduce the rotation speed of the fuel pump 14 to an appropriate level required at the start time of the fuel cut-off operation. Thus, the delay time period is set to be longer when a set fuel pressure is high or when the amount of the fuel discharged immediately before the fuel cut-off operation start is large.

At step 109, a driving voltage Vcut being applied to the fuel pump 14 while the fuel cut-off operation is performed is calculated, according to a target fuel pressure Po and an engine fuel consumption amount Qeng, using a map stored in the ROM and indicating the relationship between the target fuel pressure Po and the fuel consumption amount Qeng. It is to be noted that the driving voltage Vcut being applied to the fuel pump 14 while the fuel cut-off operation is being performed is a minimum voltage for keeping the fuel pressure at the target fuel pressure Po and that the target fuel pressure Po is a fuel pressure to be controlled after the fuel cut-off operation terminates and set to 300 kPa or in proximity thereto.

At step 110, the delay counter CNT is checked to determine whether or not the predetermined delay time period has elapsed from the time at which the fuel cut-off condition was satisfied. If YES (CNT>0), the program goes to step 111 at which a value determined by subtracting a voltage drop amount Vdec from the basic driving voltage Vfp is set as a new basic driving voltage Vfp. The basic driving voltage Vfp is dropped gradually with the elapse of time after the fuel cut-off condition is satisfied by repeatedly executing the processing at step 111 until the predetermined delay time period elapses from the time at which the fuel cut-off condition is satisfied. In this execution, the lower limit value of the basic driving voltage Vfp does not become lower than the driving voltage Vcut being applied to the fuel pump 14 while the fuel cut-off operation is being performed. If the predetermined delay time period has elapsed from the time at which the fuel cut-off condition was satisfied, the value of the delay counter CNT becomes "0". Then, in order to start the fuel cut-off operation, the program goes from step 110 to step 112 at which the basic driving voltage Vfp is set to the driving voltage Vcut, determined at step 109, being applied to the fuel pump 14 while the fuel cut-off operation is being performed. As described above, the driving voltage Vcut to be applied to the fuel pump 14 while the fuel cut-off operation is being performed is a minimum voltage for keeping the fuel pressure at the target fuel pressure Po.

After the basic driving voltage Vfp is set at step 111 or 112, the program goes to step 113 at which the feedback correction amount Vfb(i−1) used in the execution at the previous time is substituted for the feedback correction amount Vfb(i) determined in the execution at the current time. In this manner, updating of the feedback correction amount Vfb is prohibited for the predetermined period of time between the time at which the fuel cut-off condition is satisfied and the time at which the fuel cut-off operation terminates, and the feedback correction amount Vfb used immediately before the fuel cut-off condition is satisfied is maintained until the fuel cut-off operation terminates. Then, at step 104, the driving voltage Vo is determined by adding the feedback correction amount Vfb to the basic driving voltage Vfp. Thereafter, at step 105, the driving voltage Vo is applied to the fuel pump 14 to drive it.

Figure 3:
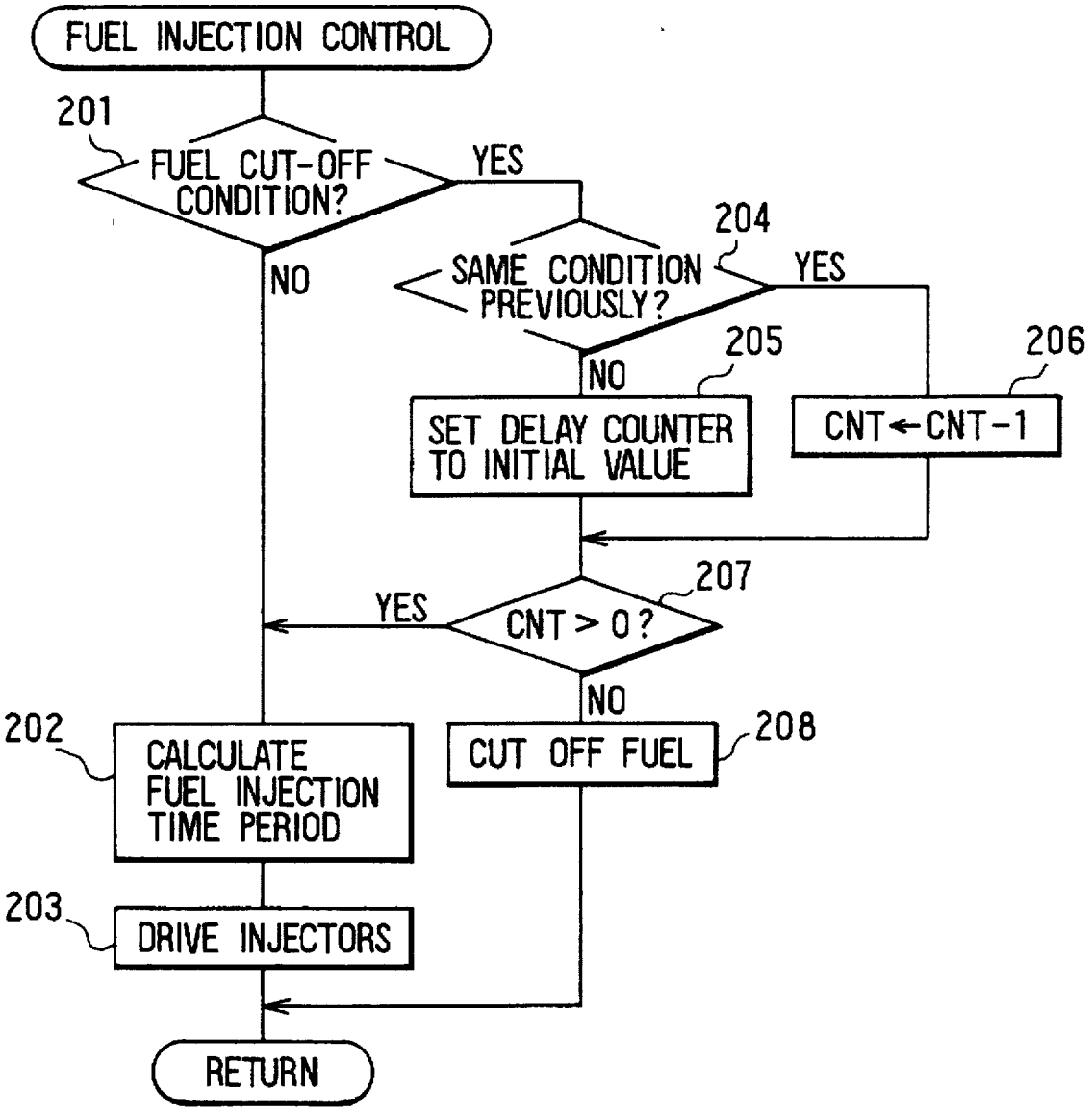
FIG. 3 is a flowchart showing a flow in executing processing of a fuel injection control routine.

The processing of the fuel injection control to be executed by the ECU 22 in the fuel cut-off operation is described below with reference to FIG. 3.

When the processing of the fuel injection control starts, it is determined at step 201 whether or not the fuel cut-off condition is satisfied, as done at step 101 shown in FIG. 2. If NO at step 201, the program goes to step 202 at which utilizing a known calculation method, a fuel injection period of time is determined. For example, firstly, a basic injection time period is determined from the rotation speed NE of the engine and the pressure Pm inside the intake pipe, using the map stored in the ROM. Secondly, the basic injection time period is multiplied by coefficients (air-fuel ratio correction factor and temperature correction factor). Thirdly, an invalid injection time period is added to the value determined by the multiplication. In this manner, the fuel injection time period is determined. At step 203, the injectors 19 are driven based on the fuel injection time period determined at step 202 so as to inject the fuel.

If it is determined at step 201 that the fuel cut-off condition is satisfied, the program goes to step 204. The processings to be executed at step 204 through step 207 are similar to those to be executed at step 106 through step 108 and step 106 through step 110. Thus, the description of the processings to be executed at step 204 through step 207 is omitted herein for brevity. If the value of the delay counter is greater than "0" at step 207, it is determined that the pressure of the fuel has not dropped sufficiently. Then, the program goes to step 202 at which a normal fuel injection control is executed. If the value of the delay counter is smaller than "0" at step 207, it is determined that the pressure of the fuel has dropped to an appropriate degree. Thereafter, the program goes to step 208 at which the fuel cut-off operation is executed and the processing terminates.

Figures 4A, 4B, 4C, 4D, 4E:
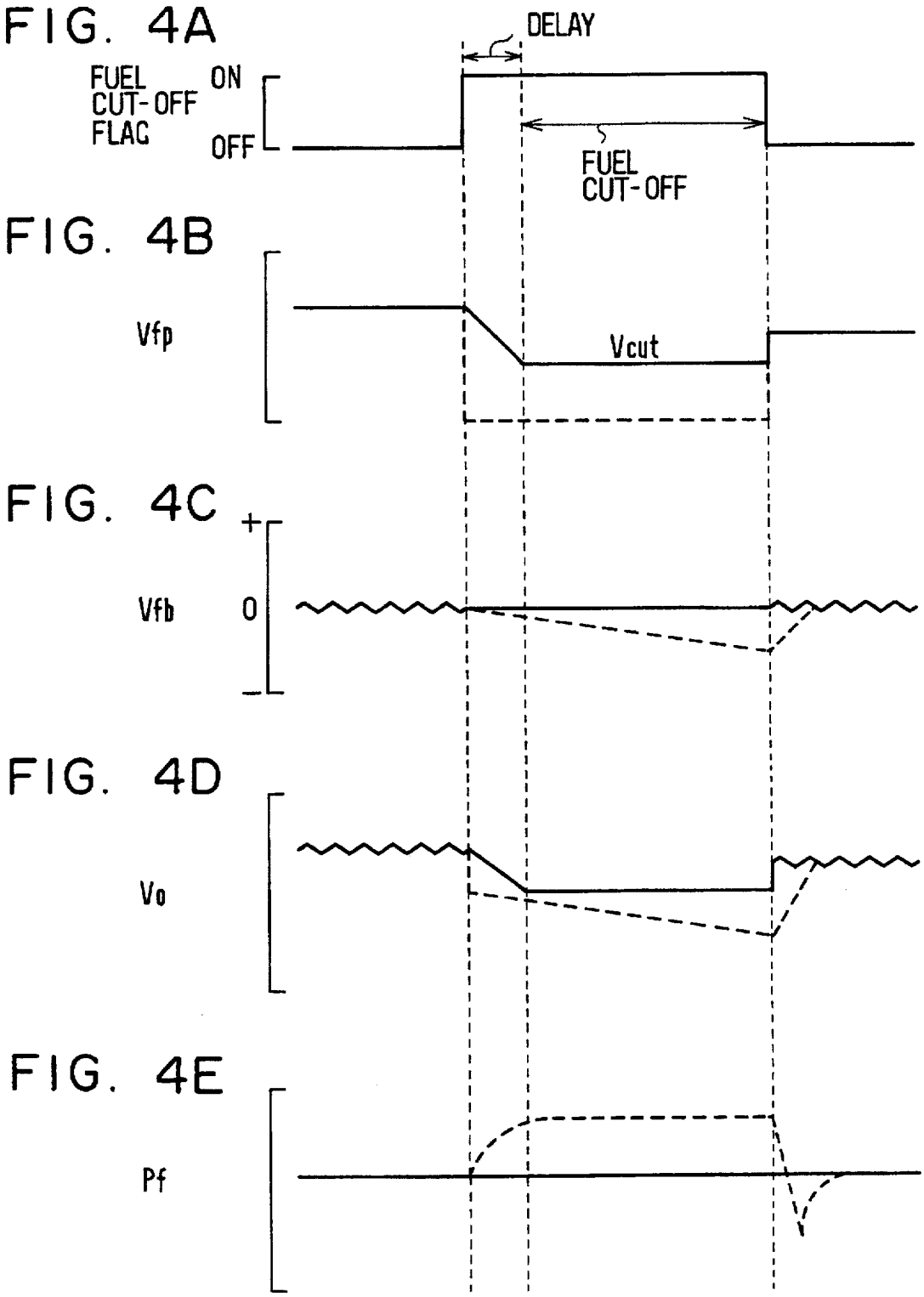
FIGS. 4A to 4E are time charts showing behavior at the time when a fuel cut-off condition is satisfied.

The operation of the embodiment in the execution of the fuel pump control routine and the fuel injection control routine is described below with reference to time charts shown in FIGS. 4A to 4E in which the solid line and the dotted line show operations of the present embodiment and the prior art, respectively. The fuel cut-off operation is not started until the predetermined delay time period CNT elapses, even though the fuel cut-off condition is satisfied (fuel cut-off flag is ON), as shown in FIG. 4A. After the fuel cut-off condition is satisfied, the basic driving voltage Vfp is decreased gradually until the predetermined delay time period CNT elapses, as shown in FIG. 4B. In this manner, as shown in FIG. 4D, the driving voltage Vo (=basic driving voltage Vfp+feedback correction amount Vfb) is dropped gradually to decrease correspondingly the rotation speed of the fuel pump 14 gradually. When the predetermined delay time period CNT has elapsed, the fuel cut-off operation starts. Before the fuel cut-off operation starts, the driving voltage vo has been dropped gradually and thus the rotation speed of the fuel pump 14 has been reduced. Therefore, when the fuel cut-off operation starts, the discharge pressure Pf of the fuel pump 14 is small. Accordingly, the rise of the fuel pressure Pf to be generated in the fuel returnless pipe construction immediately after the fuel cut-off operation starts can be prevented as shown in FIG. 4E.

In the normal control, as described previously, the higher a fuel pressure is, the greater torque the fuel pump 14 has, and the more the amount of the fuel discharged immediately before the fuel cut-off operation starts is, the larger rotation speed the fuel pump 14 has. Therefore, the fuel pump 14 has a great inertia in the normal control and hence it takes long to reduce the degree of the inertia (rotation speed) of the fuel pump 14 to an appropriate one required at the start time of the fuel cut-off operation. Thus, the delay time period CNT is set to be long when the fuel pressure is high or when the amount of the fuel discharged immediately before the fuel cut-off operation starts is great. In this manner, the delay time period CNT can be set to a minimum necessary time period in correspondence to the rotation speed of the fuel pump 14 at a time immediately before the fuel cut-off condition is satisfied. Thus, it is possible to start the fuel cut-off operation in a minimum delay. During the fuel cut-off operation, the driving voltage Vo is fixed to the minimum voltage Vcut necessary for maintaining the fuel pressure at the target fuel pressure Po, and the fuel pressure during the fuel cut-off operation is maintained at the target fuel pressure Po.

In the conventional art shown by the dotted lines, the fuel pump is stopped immediately after the fuel cut-off condition is satisfied (after fuel cut-off flag is ON) to start immediately the fuel cut-off operation. Thus, the fuel pump continues to rotate by its inertia for some time immediately after the fuel cut-off operation starts, thereby raising the fuel pressure as shown by the dotted line in FIG. 4E.

In the present embodiment, as shown in FIG. 4C, updating of the feedback correction amount Vfb is prohibited for the predetermined period of time between the time at which the fuel cut-off condition is satisfied and the time at which the fuel cut-off operation terminates, and the feedback correction amount Vfb to be used immediately before the fuel cut-off condition is satisfied is maintained. Accordingly, the feedback correction amount Vfb used immediately before the fuel cut-off condition is satisfied is used to execute a feedback control to be executed immediately after the fuel cut-off operation terminates.

According to the conventional art, as shown by the dotted line in FIG. 4C, the feedback correction amount Vfb is updated even during the fuel cut-off operation in order to drop the fuel pressure Pf which has risen after the start of the fuel cut-off operation. Thus, the feedback correction amount Vfb becomes a great negative value when the fuel cut-off operation terminates. Consequently, according to the conventional art, in adjusting the driving voltage Vo by the feedback control after the termination of the fuel cut-off operation, the driving voltage Vo (=basic driving voltage Vfp+feedback correction amount Vfb) becomes too small and thus the discharge pressure of the fuel pump is insufficient. As a result, the fuel pressure Pf generated immediately after the termination of the fuel cut-off operation drops rapidly as shown by the dotted line in FIG. 4E and a stable fuel injection amount cannot be obtained and hence the air-fuel ratio of air-fuel mixture becomes leaner than the stoichiometric air-fuel ratio. Thus, the conventional fuel supply system has a poor drive performance and generates noxious exhaust emissions.

In the present embodiment, on the contrary, the updating of the feedback correction amount Vfb is prohibited for the predetermined period of time between the time at which the fuel cut-off condition is satisfied and the time at which the fuel cut-off operation terminates. Accordingly, the feedback control immediately after the fuel cut-off condition terminates is executed by using the feedback correction amount Vfb used immediately before the fuel cut-off condition is satisfied. Consequently, the feedback correction amount Vfb to be used immediately after the fuel cut-off condition terminates becomes an appropriate value not affected by the fuel cut-off operation. Thus, the fuel pressure Pf generated immediately after the fuel cut-off operation terminates can be prevented from dropping and maintained at the target fuel pressure as shown in FIG. 4C. Owing to this construction, improved fuel control characteristic and fuel injection characteristic are provided immediately after fuel cut-off operation terminates. Thus the present invention provides an improved drive performance and exhaust gas emission.

In the present embodiment, the driving voltage Vo is dropped gradually during the delay time period CNT after the fuel cut-off condition is satisfied. It is however possible to drop the driving voltage Vo directly to the voltage Vcut to be used during the fuel cut-off operation, immediately after the fuel cut-off condition is satisfied. In this case, too, the rotation speed of the fuel pump 14 decreases gradually owing to the inertia of the fuel pump 14. Thus, the fuel pressure can be prevented from fluctuating.

In the embodiment, the driving voltage Vo is adjusted by the feedback control, based on the fuel pressure detected by the fuel pressure sensor 21. The driving voltage Vo may be adjusted by PID (proportional-integral-derivative) control.

The embodiment is applied to the fuel supply system in which the voltage for driving the fuel pump is controlled so that the pressure detected by the fuel pressure sensor becomes the target pressure. In addition, the fuel supply system of the embodiment is applicable to a fuel supply system proposed in U.S. application Ser. No. 08/668,382 filed on Jun. 21, 1996 in which electric current for driving the fuel pump is adjusted to be constant. In the case, it is unnecessary to execute the processing at step 102 through step 105 in the flowchart of FIG. 2, because the drive of the fuel pump is controlled by applying constant current thereto. In this case, at step 109, instead of determining the driving voltage Vcut, driving electric current to be applied to the fuel pump during the fuel cut-off operation is determined (fixed value may be allowed). Then, at steps 111 through 113, instead of dropping the driving voltage, reduced driving electric current is applied to the fuel pump. When the drive of the fuel pump is controlled by applying constant current to the fuel pump, the intensity of the driving electric current determined at step 109 is returned to the driving electric current applied to the fuel pump before the fuel cut-off operation starts. In this manner, the fuel pressure can be adjusted to be a target fuel pressure, immediately after the fuel cut-off operation terminates.

Further, in the present embodiment, in order to lower the fuel supply performance of the fuel pump, the voltage or the electric current for driving it is controlled when the fuel cut-off condition is satisfied. In addition, the fuel supply performance of the fuel pump may be reduced by other means.

Other modifications and variations of the embodiment are also possible to those skilled in the art without departing from the spirit and the scope of the present invention.

What is claimed is:

1. A fuel supply system for an internal combustion engine comprising:

a fuel injector;

a fuel tank;

a fuel pump for supplying the fuel stored in the fuel tank;

control means for controlling a drive of the fuel pump to adjust a pressure of the fuel to be supplied to the injector;

fuel cut-off means for stopping the injectors from injecting the fuel into the engine during a predetermined fuel cut-off condition; and delay means for delaying a fuel cut-off operation of the fuel cut-off means for a predetermined delay period of time after an occurrence of the fuel cut-off condition, wherein the control means reduces a fuel supply performance of the fuel pump during the fuel cut-off condition.

2. The fuel supply system for the internal combustion engine according to claim 1, wherein:

the control means reduces a driving force of the fuel pump when the fuel cut-off condition occurs.

3. The fuel supply system for the internal combustion engine according to claim 2, wherein:

the control means reduces the rotation speed of the fuel pump when the fuel cut-off condition occurs.

4. The fuel supply system for the internal combustion engine according to claim 3, wherein:

the control means controls a voltage for driving the fuel pump so as to adjust the pressure of the fuel to be supplied to the injectors and reduces the voltage for driving the fuel pump when the fuel cut-off condition occurs.

5. The fuel supply system for the internal combustion engine according to claim 4, wherein:

during the fuel cut-off operation, the voltage for driving the fuel pump is set to a possible minimum voltage for maintaining a target fuel pressure to be generated after a termination of the fuel cut-off operation.

6. The fuel supply system for the internal combustion engine according to claim 4, wherein:

the control means reduces the voltage for driving the fuel pump gradually for the predetermined delay period of time.

7. The fuel supply system for the internal combustion engine according to claim 1, wherein:

the predetermined delay period of time is set longer as at least one of a pressure of the fuel and an amount of the fuel discharged immediately before the fuel cut-off condition is greater.

8. The fuel supply system for the internal combustion engine according to claim 1, wherein:

for the predetermined delay period of time, the control means prohibits updating of a feedback correction amount to be used in a fuel pressure feedback control, thus maintaining the feedback correction amount used immediately before the fuel cut-off condition.

9. A fuel supply control method for an engine having a fuel tank, a fuel pump, a fuel injector and a returnless fuel pipe connecting the fuel pump and the injector, the method comprising the steps of:

detecting a predetermined engine condition for a fuel cut-off operation of the injector;

preventing the fuel cut-off operation of the injector for a predetermined delay period from the detection of the predetermined engine condition;

cutting off a fuel injection of the injector after the predetermined delay period; and reducing a rotation speed of the fuel pump during the predetermined delay time.

10. The fuel supply control method according to claim 9, further comprising the step of:

maintaining the rotation speed of the fuel pump at a reduced speed for a period of a fuel cut-off operation of the injector.

11. The fuel supply control method according to claim 9 further comprising the step of:

determining the predetermined delay period in correspondence with a pressure of fuel discharged by the fuel pump before the detection of the predetermined engine condition.

12. The fuel supply control method according to claim 9 further comprising the steps of:

feedback-controlling the fuel pump by a feedback correction amount varying in correspondence to a difference between a target fuel pressure and an actual fuel pressure before the predetermined engine condition is detected;

maintaining the feedback correction amount unchanged after the predetermined engine condition is detected; and resuming, after a termination of the fuel cut-off operation, the feedback-control for the fuel pump from the feedback correction amount maintained unchanged.

13. A fuel supply control method for an engine having a fuel tank, a fuel pump, a fuel injector and a returnless fuel pipe connecting the fuel pump and the injector, the method comprising the steps of:

detecting a predetermined engine condition for a fuel cut-off operation of the injector;

cutting off a fuel injection of the injector after the detection of the predetermined engine condition; and lowering a fuel discharge capacity of the fuel pump after the detection of the predetermined engine condition thereby to maintain a fuel pressure in the returnless fuel pipe unchanged during a fuel cut-off operation of the injector.

* * * * *